United States Patent [19]

McColly

[11] Patent Number: 4,809,896

[45] Date of Patent: Mar. 7, 1989

[54] BACKPACK HARNESS

[76] Inventor: Joseph A. McColly, 5937 Llano Ave., Dallas, Tex. 75206

[21] Appl. No.: 55,989

[22] Filed: Jun. 1, 1987

[51] Int. Cl.[4] ..... A45F 3/00

[52] U.S. Cl. ..... 224/259; 224/209

[58] Field of Search ..... 224/209-216, 224/259-263, 202

[56] References Cited

U.S. PATENT DOCUMENTS

| | | | |
|---|---|---|---|
| 946,856 | 1/1910 | Harriman | 224/214 |
| 995,963 | 6/1911 | Harriman | 224/214 |
| 1,816,510 | 7/1931 | Anderson | 224/212 |
| 4,082,208 | 4/1978 | Lane, Jr. | 224/209 |
| 4,327,852 | 5/1982 | Gibson | 224/209 X |

FOREIGN PATENT DOCUMENTS

| | | | |
|---|---|---|---|
| 208082 | 3/1909 | Fed. Rep. of Germany | 224/214 |

*Primary Examiner*—Henry J. Recla
*Assistant Examiner*—Ernest G. Cusick
*Attorney, Agent, or Firm*—John F. Booth; Gerald G. Crutsinger; Norman L. Gundel

[57] ABSTRACT

A comfortable backpacking harness including a plurality of flexible shoulder straps connected end to end by buckles to form an endless belt and a plurality of adjustable length article engaging loops permanently connected to the shoulder strap assembly. The shoulder straps and article engaging loops connected together in a manner to form a weight supporting quadrilateral on the back of the wearer whereby loads of any shape or weight can be carried by the harness.

5 Claims, 2 Drawing Sheets

BACKPACK HARNESS

BACKGROUND OF THE INVENTION

1. Field of the Invention

This invention relates to a load carrying harness and more particularly to a comfortable, efficient, lightweight, flexible harness useful as a backpacking harness for carrying articles on a person's back.

2. Description of the Prior Art

The use of backpacking harness has become increasingly popular in recent years, and elaborate equipment has been developed for various uses ranging from the carrying of books by students to camping equipment and supplies by outdoorsman. Such equipment generally has included a rigid frame structure supported on the back by a system of straps extending over the shoulder and around the body of the wearer, with a canvas cover supported on the frame to provide packets, ties, and the like for containing and carrying articles. It is also known to provide lightweight backpack pouches or knapsacks supported on the back by shoulder straps. Such equipment, however, is relatively bulky, even when formed from the lightweight, high strength synthetic fabric materials now available so that, when empty, the device cannot comfortably be worn under outer clothing or conveniently carried in a pocket. Further, the lightweight knapsack type equipment generally available does not provide for carrying relatively large, irregularly shaped articles.

A carrying harness is also known to include flexible shoulder straps employed in combination with a waist-encircling belt or strap to distribute weight between the shoulders and hips. A device of this type is shown in U.S. Pat. No. 4,327,852. In U.S. Pat. No. 4,327,852, the prior art cross frame type harness is shown for use in carrying lightweight articles.

While the prior art devices of the type described above have generally been useful for their intended purposes, there has remained a need for a compact, comfortable backpack harness for general purpose use in the carrying of all types and sizes of articles. For example, hunters, or hikers on a days outing may require heavy coats in early morning or late afternoon hours which are not needed during the warmer portion of the day. Carrying of such excess clothing, when not being worn, interferes with the free use of a person's hands and it would be convenient to have a means for carrying such articles when needed and which would not interfere with the persons movement or activity when not in use. Accordingly, it is the primary object to the present invention to provide an improved, lightweight, flexible and compact backpack harness which can be used to carry heavy loads or irregular objects.

BRIEF DESCRIPTION OF THE DRAWINGS

The foregoing and other objects and advantages of the present invention will be apparent from the following detailed description, taken in conjunction with the drawings, in which.

DESCRIPTION OF PREFERRED EMBODIMENT

Figure 1:
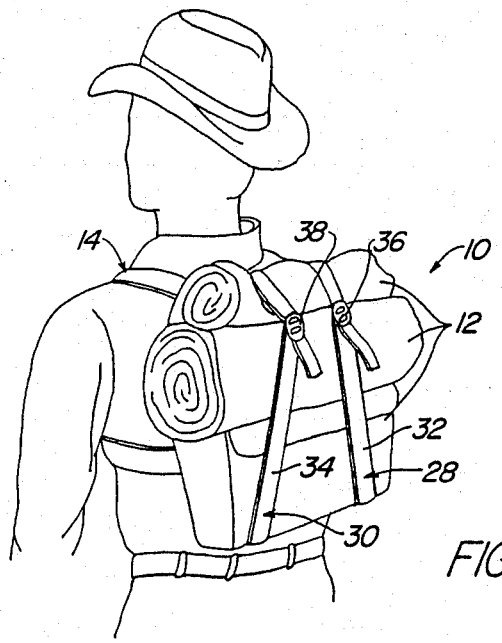
FIG. 1 is a rear perspective view of the backpack harness of the present invention shown in use.

Referring now to the drawings wherein like reference characters designate like or corresponding parts throughout the several views, there is shown in the figures the improved backpacking harness according to the present invention which is designated for reference purposes by numeral 10.

In FIG. 1, the improved backpack harness 10 of the present invention is shown being used to carry articles 12. For purposes of illustration, the articles 12 are shown as a collection of camping gear; however, it is to be understood of course that many different kinds and shapes of articles could be carried.

Figure 2:
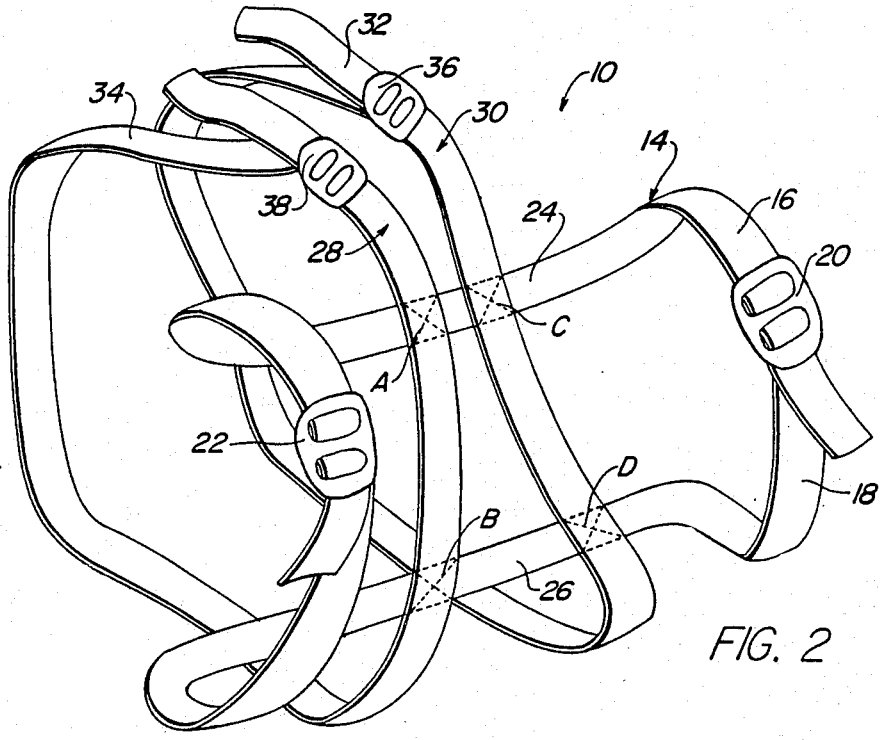
FIG. 2 is a front perspective view of the harness in the shape taken when worn.

By referring to both FIGS. 1 and 2, the details of construction of the improved harness 10 of the present invention and the use and advantages of the various figures thereof can be seen. The backpack harness 10 comprises a shoulder strap engaging assembly 14. The shoulder strap assembly 14 is formed in an endless loop which in the preferred embodiment is made affirm to elongated flexible shoulder straps 16 and 18 and to adjustable shoulder strap fastener means which are shown as buckles 20 and 22. The buckles are positioned on opposite sides of the assembly to releaseably join the ends of the shoulder straps 16 and 18 together in a manner such that the length of the endless belt or loop formed by the shoulder strap assembly 14 can be independently adjusted by use of either of the buckles 20 and 22. This adjustment of length of the shoulder strap assembly 14 allows the harness to be adjusted to fit various sizes of individuals when the shoulder strap assembly is worn over the shoulder and under the arms as shown in FIG. 1. According to a particular feature of the present invention, the shoulder strap assembly has two horizontally extending spaced parallel portions 24 and 26. As shown in FIG. 2, when the assembly 10 is worn, the upper horizontal portion 24 and lower horizontal portion 26 form a spaced support frame to contribute to the strength, versatility, and comfort to the backpacking harness 10 of the present invention. It is to be understood of course that the adjustable shoulder strap assembly as illustrated is comprising at least two shoulder straps and adjustable fasteners 20 and 22. It is to be understood of course that more than two separate shoulder straps could be utilized and still provide the adjustment of the length of the endless shoulder strap assembly in at least the area of the two shoulders to provide snug fit. It is also to be understood that more than two adjustable fasteners could be used and that fasteners of different types other than buckles could be used to achieve the purpose of providing adjustment and snug fitting of the shoulder strap assembly.

According to another feature of the present invention, at least two article-supporting flexible strap assemblies 28 and 30 are used. These two article supporting strap assemblies are provided for attaching articles to the improved backpack harness of the present invention. In the present embodiment, the two assemblies 28 and 30 are each constructed from endless flexible straps 32 and 34 respectively. Strap 32 has its ends connected together by means of an adjustable fastener 36 while the strap 34 has its ends connected together by an adjustable fastener 38. In the embodiment shown, the fasteners 36 and 38 are buckles which allow the length of the article supporting strap assemblies 28 and 30 to be adjusted to fit snugly around the articles 12 as is shown in FIG. 1. Article supporting strap assembly 28 is connected to the upper horizontal portion 24 at A and the lower horizontal portion 26 at B. The article supporting strap assembly 30 is likewise connected to the upper horizontal portion 24 at C and is connected to the lower horizontal portion 26 at D. It is to be understood, of course, that strap 32 could join at buckle 35 and strap 34 could join at buckle 36, crossing the article-supporting straps in order to accommodate a wider variety of load sizes and shapes. In the preferred embodiment shown, the connections A through D are made by sewing the flexible-straps of the various assemblies together to form a flexible quadrilateral frame A-B.-, B-D, D-C and C-A.

As shown in FIG. 2, the strap assemblies 14, 28 and 30 are interlocked such that the straps 32 and 34 pass on the inside or side adjacent to the wearer of the straps 16 and 18. By interlocking the straps, the connections A-D are not stretched in tension whereby the interlocking of the straps provides majority of the support for the articles supported by the harness. It is to be understood of course that other types of connections such as rivets or even buckles could be used to connect the straps assemblies together as shown in FIG. 2.

From the foregoing, it should be readily apparent that the collapsible backpack harness 10 can be used by an individual to carry various types and sizes of articles. The upper first and lower second elongated flexible shoulder straps 16 and 18, respectively, and the first and second article-supporting straps 32 and 34 are joined such that portion 24 of the first strap 16 and portion 26 of the second strap 18 are positioned to extend horizontally across the back of a wearer. Ends of the first shoulder strap 16 are positioned to extend over the shoulders of the wearer and ends of the second shoulder strap 18 are positioned to extend under the arms of the wearer.

Adjustable shoulder strap fasteners 20 and 22 releasably join ends of the first and second shoulder straps 16 and 18 together to form a continuous shoulder strap assembly loop 14. The adjustable article-supporting strap fasteners 36 and 38 secure ends of the article-supporting straps 32 and 34 together to form a pair of generally vertically disposed article-supporting assembly loops 28 and 30 which extend around and support an article 12 to be carried from the harness. As illustrated in FIGS. 1 and 2, the first and second shoulder straps 16 and 18 extend through the pair of generally vertically disposed loops 28 and 30 formed by the article-supporting straps 32 and 34 in an interlocking relationship such that portions 24 and 26 of the article-supporting straps 16 and 18 are positioned between the first and second shoulder straps 16 and 18 and the back of a wearer when the harness 10 is in use. Connectors A-D are formed by sewing each of the article-supporting straps 32 and 34 to shoulder strap 16 at horizontally spaced locations A and C and sewing each of the article-supporting straps 32 and 34 to shoulder strap 18 at second horizontally spaced locations B and D such that the second horizontally spaced locations B and D on portion 24 of strap 16 are spaced further apart than the first horizontally spaced portions A and C on strap 18. This positioning of connectors A and C relative to the position of connectors B and D causes shoulder straps 16 and 18 of shoulder straps assembly 14 to be maintained in a comfortable, yet snug position when secured about the shoulders of a wearer.

The portions of straps 16, 18, 32 and 34 define a around the periphery of quadrilateral shaped flexible frame A, B, C, D maintain the harness 10 in a configuration to maximize comfort to the wearer while minimizing the weight and complexity of harness 10.

From the foregoing, it can be seen that the backpacking harness 10 of the present invention is collapsible and can be folded up into a small size and carried by an individual in a convenient place. The harness can be assembled and worn as shown in FIG. 1 to be used to carry a variety of types and sizes of articles. It it to be understood of course that the foregoing description of the harness of the present invention is the preferred embodiment of the invention and it is anticipated that numerous modifications or alternations can be made therein without departing from the spirit and scope of the invention as defined by the claims appended hereto.

What I claim is:

1. A collapsible backpacking harness of the type which can be used by an individual to carry various types and sizes of articles, comprising:

a shoulder strap assembly comprising at least two elongated flexible shoulder straps;

adjustable shoulder strap fastener means releasably joining the ends of the shoulder straps together to form an endless belt of variable length whereby the shoulder straps can be worn over the shoulder and under the arms to extend horizontally across the back of the wearer at two spaced levels and whereby the length of each endless belt can be adjusted to fit snugly over the wearer;

at least two article-supporting flexible straps;

means fixing said article-supporting straps to each of said shoulder straps at intermediate spaced locations whereby two of said article-supporting straps extend vertically along the back of the wearer, and the portion of said two article-supporting straps and of said two adjustable shoulder straps between said fixing means defines a quadrilateral flexible frame, said article-supporting straps being of a sufficient length to extend an article to be carried; and adjustable article-supporting strap fastener means releasably connecting the ends of each article-supporting straps to form loops of separate endless straps of variable lengths, whereby the length of the article supporting strap can be adjusted to extend around and support the article to be carried from the harness.

2. A collapsible backpacking harness according to claim 1, said fixing means being formed by sewing each of said article-supporting straps to one of said shoulder straps.

3. A collapsible backpacking harness according to claim 2, said adjustable shoulder strap fastener means comprises: buckles.

4. A collapsible backpacking harness according to claim 3, said adjustable article-supporting strap fastener means comprises: buckles.

5. A collapsible backpacking harness according to claim 1, said means fixing said article-supporting straps to said shoulder straps at spaced locations being adapted to position said shoulder straps and said article-supporting straps in an interlocking relationship such that said article-supporting straps extend through loops formed by said endless belts.

* * * * *

UNITED STATES PATENT AND TRADEMARK OFFICE

CERTIFICATE OF CORRECTION

PATENT NO. : 4,809,896

DATED : March 7, 1989

INVENTOR(S) : Joseph A. McColly

It is certified that error appears in the above-identified patent and that said Letters Patent is hereby corrected as shown below:

In Column 3, line 64, delete -- around the periphery of --.

Signed and Sealed this

Twenty-second Day of August, 1989

*Attest:*

DONALD J. QUIGG

*Attesting Officer*

*Commissioner of Patents and Trademarks*